United States Patent [19]

Bloomquist

[11] 4,102,084

[45] Jul. 25, 1978

[54] WET SANDING DEVICE

[76] Inventor: Thomas N. Bloomquist, 12685 Buchanan St., Blaine, Minn. 55434

[21] Appl. No.: 824,063

[22] Filed: Aug. 12, 1977

[51] Int. Cl.[2] ..... B24B 23/02

[52] U.S. Cl. ..... 51/170 MT; 51/267; 51/134.5 F

[58] Field of Search ..... 51/267, 134.5 F, 266, 51/170 MT; 15/230.1

[56] References Cited

U.S. PATENT DOCUMENTS

| | | | |
|---|---|---|---|
| 1,698,970 | 1/1929 | Shaff | 51/267 |
| 1,706,402 | 3/1929 | Hawn | 51/267 |
| 1,971,790 | 8/1934 | Mall | 51/267 |
| 2,733,562 | 2/1956 | Drummond | 51/267 |
| 2,794,303 | 6/1957 | Wickes | 51/170 MT |
| 3,099,905 | 8/1963 | Rebechini et al. | 51/263 X |

FOREIGN PATENT DOCUMENTS

| | | | |
|---|---|---|---|
| 1,436,072 | 5/1976 | United Kingdom | 51/267 |

*Primary Examiner*—Harold D. Whitehead
*Assistant Examiner*—Roscoe V. Parker
*Attorney, Agent, or Firm*—Leo Gregory

[57] ABSTRACT

The invention herein relates to a vehicle body sanding device in which the improvement consists of having a water line feed a stream of water through the device to the sanding disc thereof to be dispersed by the action of the sanding disc over the surface being sanded for a wet dust free sanding operation.

1 Claim, 3 Drawing Figures

WET SANDING DEVICE

BACKGROUND AND SUMMARY OF THE INVENTION

The invention herein relates to a device or an apparatus for sanding vehicle bodies for repair or repainting purposes. It is a general practice to use dry sanding devices which create and spread considerable amounts of dust resulting from the sanding which dust creates an unfavorable working environment for the operator, it creates a dust filled area generally and requires that the vehicle being sanded be well covered to protect the interior thereof from the entry of dust.

The improvement herein consists in having a water line embodied into the structure of the sanding apparatus, the same being arranged to feed water to the sanding disc with said water being dispersed over the area being sanded by the rotation of the sanding disc.

This improvement results in a clear air working condition, it does away with the requirement for shielding or covering the vehicle being worked upon and has been found to increase the effective useful life of the sanding disc.

It is an object of this invention therefore to provide a sanding device arranged and constructed to have water fed to the sanding disc for a wet sanding operation.

It is another object of this invention to provide a sanding device having the structure thereof embody a water line which communicates with the sanding disc.

More specifically it is an object of this invention to have a sanding disc embody a water line which extends through the handle thereof and communicates with a bore through the shaft which drives the sanding disc, through which bore water is fed centrally of the sanding disc to be dispersed by the rotation of the disc onto the surface being sanded for a wet sanding operation and means in connection with the handle provide controls over the water line.

These and other objects and advantages of the invention will be set forth in the following description made in connection with the accompanying drawings in which like reference characters refer to similar parts throughout the several views and in which.

DESCRIPTION OF A PREFERRED EMBODIMENT

Figure 1:
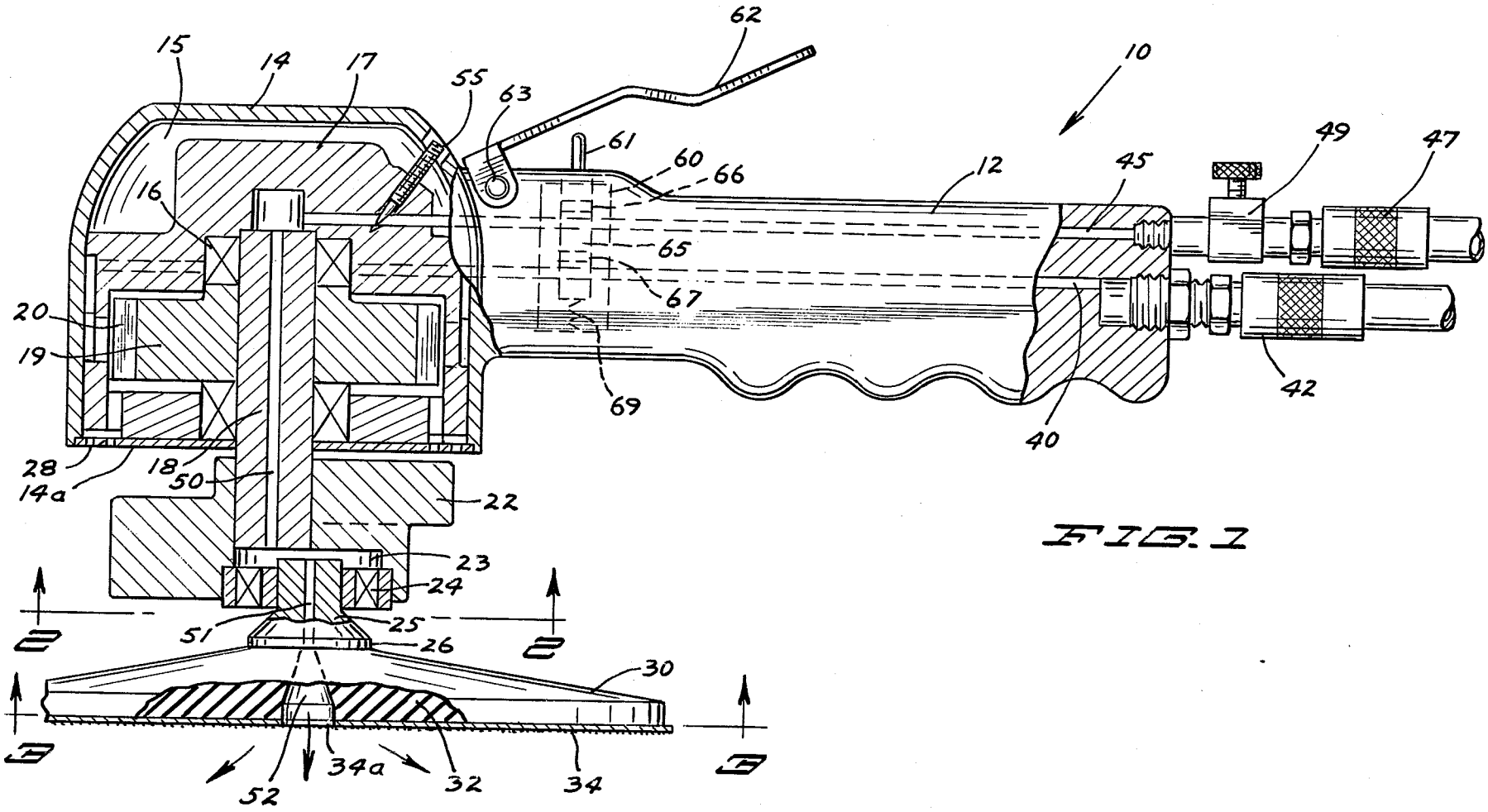
FIG. 1 is a view partially in side elevation and partially in vertical section with portions being broken away.
Figure 2:
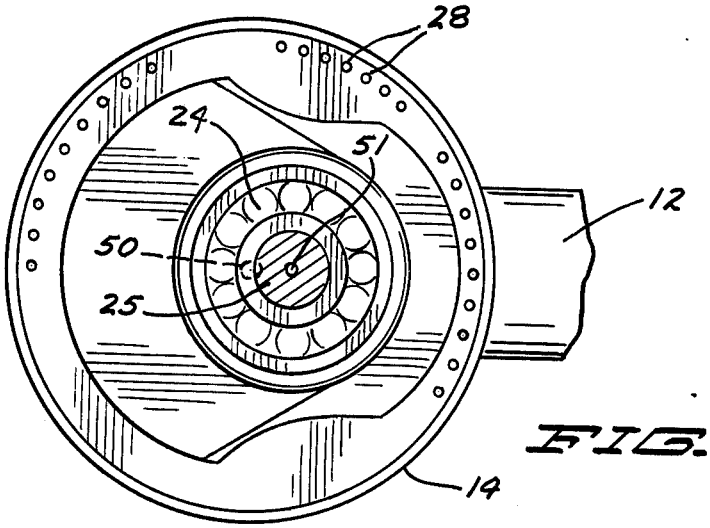
FIG. 2 is a fragmentary view in horizontal section taken on line 2—2 of FIG. 1 as indicated.
Figure 3:
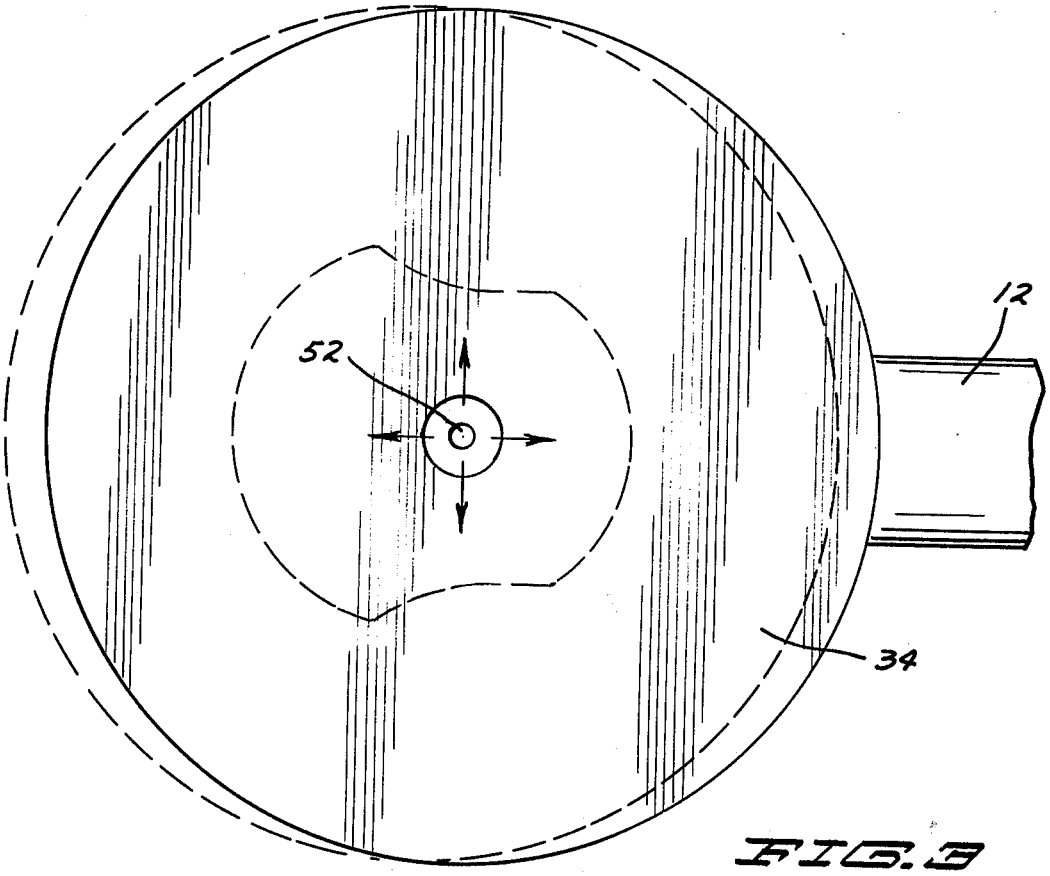
FIG. 3 is a view in horizontal section taken on line 3—3 of FIG. 1 as indicated.

Referring to the drawings the apparatus herein comprising a powered sanding device is indicated generally by reference numeral 10.

Said device consists of a grip type of a handle member 12 carrying at one end thereof a motor housing 14 having therein a chamber 15 and having disposed therein bearings 16 secured in a conventional manner by a web structure 17 and journaled in said bearings is a shaft 18. Carried on said shaft 18 is a conventional air driven motor 19 having vanes 20 projecting thereabout. Said shaft extends outwardly of said housing and secured to the extended portion thereof is a weighted rotor 22 having an open bottom recess 23 therein and having secured therein a bearing member 24. Journaled in said bearing member 24 is a stub shaft 25 having an outwardly extended flared portion 26 adapted in a conventional manner to removably carry a grinding head 30 having a facing cushion member 32 and having removably secured thereto in a conventional manner a grinding or sanding disc member 34. Said shaft has an axial bore 51 therethrough which is eccentric to the axis of the shaft 18.

Running through said handle 12 is an air line 40 having an outwardly extending portion thereof connected to a line 42 which will run to a suitable source of pressurized air. Line 40 runs into said chamber 15 wherein pressurized air engages the vanes 20 of said air motor 19.

About the periphery of the bottom **14*a* of said housing 14 are apertures 28 for the exhaust of the air driving the motor 19**.

Extending through said handle 12 is a water line 45 having an outwardly extending portion thereof connected to a line 47 running to a suitable source of water and carried by said extended end portion is a conventional flow control valve member 49.

Said water line 45 communicates with an axial bore 50 through the shaft 18 forming a continuation of said water line and said bore 50 through the recess 23 communicates with the bore 51 and said bore 51 communicates with a central opening or passage 52 in the grinding head 30. Said grinding disc 34 will have a central aperture **34*a* which through the passages 52 and 50 communicates with said water line 45**.

The shaft 18 is eccentric to the shaft 50 and the passages 51 and 50 are off-center with respect to each other. Hence the grinding disc 34 as carried by the rotor 22 is driven through a path eccentric to the axis of said shaft 18. In this manner there is an overlapping of the sanded surfaces and this is conventional.

Said housing 14 has disposed therein a needle valve 55 which intersects the water line 45 as indicated.

Carried by said handle 12 adjacent the housing 14 and disposed therein is a flow control valve structure 60 operated by a valve operating member 62 which is pivoted at 63 and by a torsion spring not here shown will be normally in an upward non-operating position.

Said valve structure 60 has a core 65 therein normally held in an upper raised position by a coil spring 69 as indicated. Passing transversally through said core member 60 are vertically spaced passages 66 and 67. When the valve core 65 is lowered by operation of the handle 62 engaging the operating extended pin member 61, the valve core will be moved against the pressure of the spring 69 to align the passages 66 and 67 respectively with the water line 45 and the air line 40.

OPERATION

The operator in using the sanding device above described will first adjust the valve 49 to provide a sufficient supply of water and will adjust the needle valve 55 for control of the velocity of water to pass through the device.

The device was held in the usual manner by the grip type handle 12 and the thumb of the operator upon the control member 62 operates the valve core 65 to simultaneously open the lines 45 and 40 for the passage of air to drive the motor 19 and for the passage of water to be dispersed by the sanding disc 34 over the area being sanded.

The axis of the sanding head 30 in being eccentric to that of the shaft 18 provides an irregular traveling path for the sanding member which results in overlapping evenly sanded surface portions. In operation, it has been found that the sanding disc disperses the water over the area being sanded very effectively to provide a wet sanding operation which eliminates the creation and spread of dust and provides for a considerable longer effective useful life of the sanding disc. Sanding discs are relatively expensive and extending the life of a sanding disc is a significantly beneficial economic factor.

At any time that the operator pauses in the sanding operation, a release of his thumb from the operating handle 62 immediately cuts off the flow of both air and water and thus both the air and water lines are under a unitary control.

It will of course be understood that various changes may be made in form, details, arrangement and proportions of the parts without departing from the scope of the invention herein which, generally stated, consists in an apparatus capable of carrying out the objects above set forth, in the parts and combinations of parts disclosed and defined in the appended claims.

What is claimed is:

1. A sanding device, having in combination a handle structure having in connection therewith a motor housing having an air motor therein comprising a plurality of vanes, a shaft driven by said motor extending outwardly of said housing, a sanding head carried by said shaft and driven by the same, an air line extending from said motor outwardly of said handle to an air supply, an axial bore through said motor shaft and an axial bore through said sanding head, said bores communicating with each other, a water line extending through said handle to a water supply, said water line extending to said bore of said motor shaft, a flow control valve structure carried by said handle, said water line and said air line having a pair of aligned vertical passages therethrough, a valve core extending through said vertical passages and having a pair of passages therethrough to simultaneously be in phase with said water line and said air line, means carried by said handle structure normally urging said valve core to be out of phase with said water line and said air line, a single operating handle engaging said valve core to urge the same to be in phase with said water line and said air line, and means controlling the flow and velocity of water through said water line.

* * * * *